United States Patent [19]

Oster

[11] Patent Number: 4,616,199

[45] Date of Patent: Oct. 7, 1986

[54] CIRCUIT BREAKER IMPROVEMENT TO PREVENT SETTING OF TRIP ASSEMBLY

[75] Inventor: Clark L. Oster, Cedar Rapids, Iowa

[73] Assignee: Square D Company, Palatine, Ill.

[21] Appl. No.: 684,561

[22] Filed: Dec. 21, 1984

[51] Int. Cl.[4] ..... H01H 73/12; H01H 77/00; H01H 81/00; H01H 83/00

[52] U.S. Cl. ..... 335/35; 335/21; 335/23; 335/46

[58] Field of Search ..... 335/21, 23, 25, 35, 335/46

[56] References Cited

U.S. PATENT DOCUMENTS

| | | | |
|---|---|---|---|
| 2,902,560 | 9/1959 | Stanback et al. | 335/25 |
| 3,073,926 | 1/1963 | Ellsworth et al. | 335/35 |
| 3,467,920 | 9/1969 | Hall et al. | 335/23 |
| 4,479,101 | 10/1984 | Checinski | 335/37 |
| 4,503,408 | 3/1985 | Mrenna et al. | 335/35 |

*Primary Examiner*—Joseph W. Hartary
*Assistant Examiner*—Lincoln Donovan
*Attorney, Agent, or Firm*—Mary R. Jankousky; Richard T. Guttman

[57] ABSTRACT

An improvement to prevent alteration of the circuit breaker calibration due to high overloads. A circuit breaker has a U-shaped current path with a brazed junction at the bend of the "U". Upon the occurrence of a large overload, the opposing current in the two legs of the U-shaped path will force the two legs of the "U" apart, possibly weakening the brazed junction. When one of the legs is a closely calibrated component of a trip assembly, the breaker will no longer operate within the proper range. A stop is placed within the housing to prevent the two legs from moving apart such a distance as will cause the brazed junction to fail.

13 Claims, 3 Drawing Figures

CIRCUIT BREAKER IMPROVEMENT TO PREVENT SETTING OF TRIP ASSEMBLY

FIELD OF THE INVENTION

This invention relates to electrical circuit breakers, and more particularly to a circuit breaker which utilizes a cantilevered type bimetal or magnetic trip yoke assembly.

DESCRIPTION OF THE PRIOR ART

The improvement may be incorporated into any circuit breaker design tripped by a magnet or bimetal suspension assembly that may be moved by magnet forces during high overloads, as will be later described. The circuit breaker described herein has an overcenter spring mechanism utilizing a bimetal and magnetic trip assembly.

The circuit breaker includes a trip lever spring biased to open the circuit breaker contacts in response to an overcurrent. When the circuit breaker contacts are in the closed position, one end of the trip lever is seated in the latch seat of an armature. The armature is connected to a bimetal that is calibrated to move a predetermined distance when an overcurrent occurs. The distance the bimetal moves varies with the level of the overcurrent.

The bimetal is cantilever supported at one end by a brazed connection to a load terminal strap. The load terminal strap is positioned close to and approximately parallel to the bimetal, so that a current through the breaker flows in opposite directions through the bimetal and load terminal strap and tends to blow them apart. The bimetal setting occurs when a high fault current creates a blow apart force that causes a separation at the brazed connection. It is desirable to prevent this setting or alteration of the original trip assembly calibration.

In the prior art, this problem was avoided by using an expensive hand braze between the bimetal and load terminal strap. Each braze was also subjected to extensive quality control checks.

The present invention reduces the force at the brazed juncture by limiting the movement of the free end of the yoke and bimetal, and thus prevents bimetal setting.

SUMMARY OF THE INVENTION

It is an object of this invention to provide apparatus for creating a more reliable circuit breaker trip assembly.

It is a further object of this invention to provide apparatus for reducing the stress on the brazed end of a thermally calibrated bimetal or magnetic assembly of a circuit breaker.

These objectives are achieved by the preferred embodiment of the present invention. In a circuit breaker design having current flowing in opposite directions through closely spaced parallel conductors, a blow-apart force is created between the two conductors. In a design in which one of the conductors is a closely calibrated bimetal or magnetic trip assembly, the blow-apart forces may alter the circuit breaker calibration. The present invention includes a stop connected to the circuit breaker housing to prevent the free end of the bimetal from moving such a distance as will cause setting.

The foregoing and other objects, features and advantages of this invention will be apparent from the following more particular description of the preferred embodiment thereof, as you will see in the accompanying drawings and the claims.

DESCRIPTION OF THE PREFERRED EMBODIMENT

Figure 1:
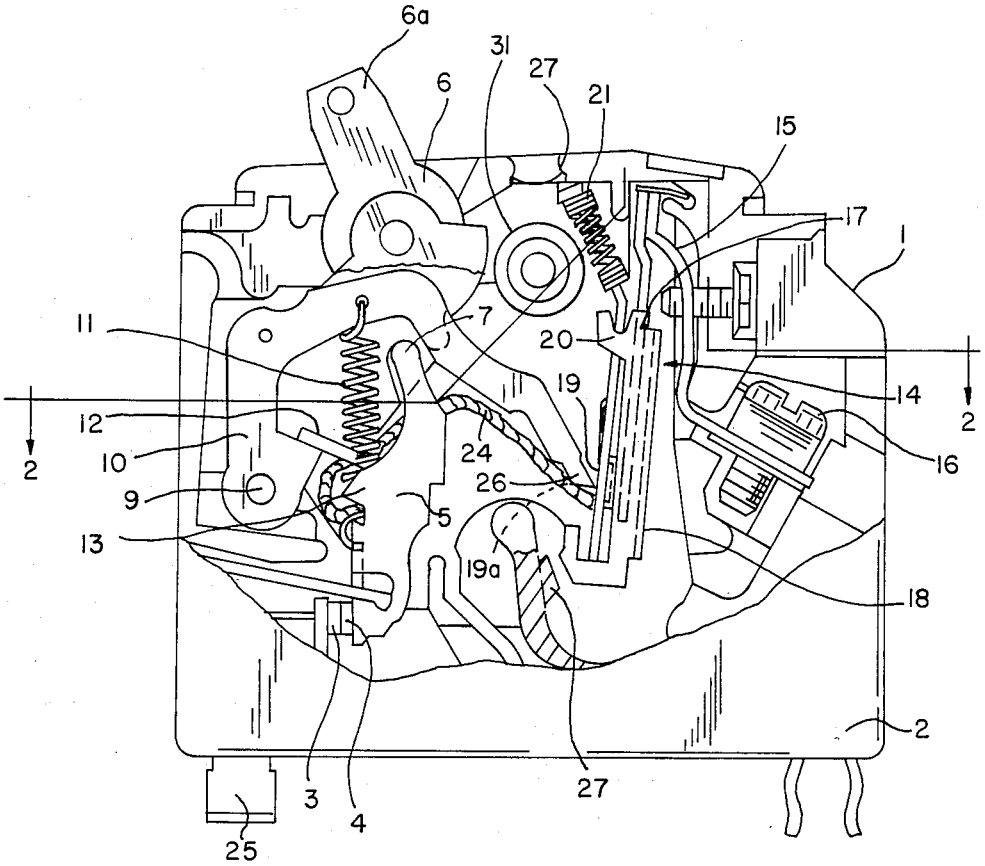
FIG. 1 is a side view of the circuit breaker with the cover partially cut away to show the contacts and operating mechanism in the on position.

Referring to the drawings, as described above, the preferred embodiment is described herein as incorporated into a circuit breaker of the type fully described in U.S. letters patent No. 2,902,560 of Stanback et al, issued Sept. 1, 1959, and herein incorporated by reference. The invention may be used with other types of breakers employing a suspended bimetal or magnetic trip assembly, as will be readily apparent from the illustrative example. The circuit breaker of U.S. Pat. No. 2,902,560 is described herein only briefly.

The breaker comprises an open housing base 1 closed by a detachable cover 2, both formed of molded insulating material. Within the base 1 are positioned a movable contact 4 mounted on a carrier 5 and a stationary contact 3. Pivotally mounted in the base 1 is a manual operator 6 having an external operating handle **6*a*. The upper end of a carrier 5 is provided with fingers 7 that are received in slots 8 in the manual operator 6 to rock within the slots 8. The carrier 5 can be rocked clockwise and counterclockwise by reciprocally pivoting the manual operator 6**.

A releasably latching trip lever 10 is pivotally mounted about a pivot 9 at one end. The latching end 26 of the trip lever 10 is seated in the latch seat **19*a* of an armature 19. The trip lever 10 is biased to seat in the latch seat 19*a* by a spring 11 that connects the trip lever 10 to the carrier 5. The spring 11 also urges the carrier upwardly to hold the upper ends of the fingers 7 in rocking contact with the slots 8 of the manual operator 6**.

The positions of the trip lever 10, carrier 5, and breaker contacts 3 and 4 are controlled by the mechanism, indicated generally as number 14 in FIG. 1. The trip mechanism 14 includes a bimetal 17 brazed at its upper end to a load terminal strap 15 which is connected to the load terminal 16. A magnetic yoke member 18 is attached to the lower end of the bimetal 17. A magnetic armature 19 is pivotally cradled at its upper end in the arms 20 of the yoke member 18. An armature spring 21 is connected to both the base 1 and the armature 19 to resiliently restrain the armature 19 from swinging relative to the yoke member 18. A flexible conductor 24 is brazed at one end to the yoke member 18 and at the other end to the carrier 5, to complete the current path through the breaker.

Figure 2:
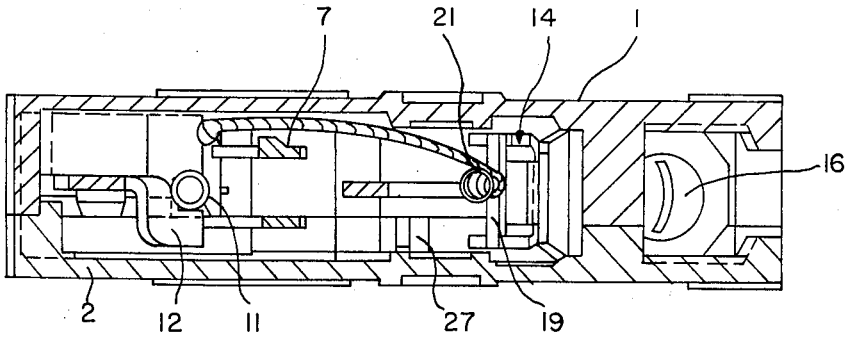
FIG. 2 is a horizontal sectional view of the circuit breaker taken along line 2—2 of FIG. 1.
Figure 3:
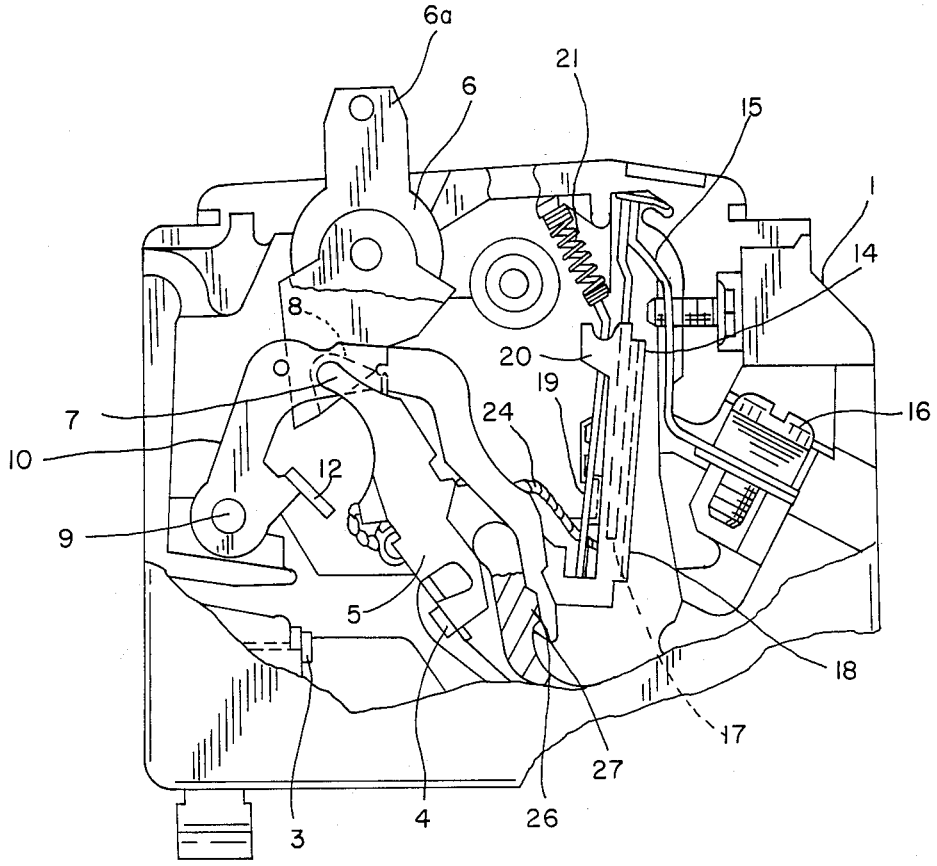
FIG. 3 is a side view of the circuit breaker with the cover partially cut away to show the contacts and operating mechanism in the tripped position.

Upon a moderate sustained overload, the bimetal 17 heats up and flexes to the right, as shown in FIGS. 1 and 2, causing the magnetic yoke and the armature 19 to swing counterclockwise. Upon the occurrence of an extreme overload, the sudden increase in current in the yoke member 18 causes the armature 19 be attracted to the yoke member 18 and to swing counterclockwise. In either event, when the armature 19 swings to the right, as shown in FIG. 3, it releases the latching end 26 of trip lever 10.

As the trip lever 10 is released, it swings clockwise carrying the upper end of the spring 11 past its dead center position. The spring 11 then moves carrier 5 to the tripped position as shown in FIG. 3, while at the same time maintaining a downward force on the trip lever 10, urging it to rotate in a clockwise direction. The trip lever 10 has an kicker 12 that, upon the trip lever being released and swinging clockwise, engages the shoulder 13 on the carrier 5 and assists in moving the carrier 5 counterclockwise, separating the breaker contacts and moving carrier 5 to a fully open position.

The trip lever 10, bimetal 17, yoke member 18 and armature 19 must be carefully calibrated to ensure that the breaker trips upon every occurrence of a fault in the desired range and only upon the occurrence of those faults.

The path of current in the breaker is through load terminal 16, load terminal strap 15, bimetal 17, conductor 24, carrier 5, movable contact 4, stationary contact 3 and line terminal 25. The load terminal strap 15 and bimetal 17 are approximately parallel to one another and the direction of current flow through the two conductors is in opposite directions. Since the load terminal strap 15 and bimetal 17 are positioned closed together, the current tends to force the conductor apart.

These "blow-apart" forces weaken the brazed connection between the bimetal 17 and the load terminal strap 15. This connection is also weakened by bending stress due to the heating of the bimetal and by the extra stress on the bimetal 17 caused by trying to overcome the friction between the latching end 26 of the trip lever and the latch surface 19*a* of the yoke member 18. These factors may cause the bimetal 17 brazed connection to the conducting strap 15 to fail.

To maintain the integrity of the bimetal calibration, a support 27 is either connected to the base 1 or cover 2, to prevent the free end of the yoke member 18 from moving a predetermined distance that is known to weaken the brazed connection. In the preferred embodiment shown in the drawings herein, the support 27 is integrally formed as a part of the cover 2. After the occurrence of a high level fault, the breaker will remain properly calibrated because the yoke member 18 has not moved beyond the elastic limits of the individual parts and connections between the parts.

While the invention has particularly been shown and described with reference to the preferred embodiment, it will be understood by those skilled in the art that variations in form, construction and arrangements may be made therein without departing from the spirit and scope of the invention. All such variations are intended to be covered in the appended claims.

I claim:

1. An automatic electric circuit breaker comprising:

a casing;

a pair of separable contacts within said casing, release means for separating said pair of contacts;

a conducting member fixed within said casing and providing a first current path;

a magnetic yoke having a supported end and a free end, said magnetic yoke extending approximately parallel to and adjacent to, but not touching said conducting member, said yoke forming a second current path, said magnetic yoke moving in a first direction upon the occurrence of an overload current to cause said release means to separate said contacts; and a stop positioned adjacent to and a predetermined distance from the free end of said yoke, said stop being located on the side of said yoke opposite said conducting member to stop the movement of said magnetic yoke at a predetermined distance in a second direction opposite to the first direction.

2. An electric circuit breaker comprising:

(a) a housing:

(b) a pair of separable contacts mounted within said housing;

(c) a conducting element fixed within the housing;

(d) a yoke having a fixed end and a free end, said yoke being positioned parallel to and proximate to said conducting element, said yoke accommodating current flow in a direction that is opposite to the direction of current flow in said conducting element, said yoke being deflected in a first direction toward said conducting element in response to a very high overcurrent through the circuit breaker;

(e) release means for separating said contacts upon activation;

(f) activating means for activating said release means upon the occurrence of an overload current through the circuit breaker, said activating means including a mechanical latch connected to said yoke; and (g) a stop positioned a predetermined distance from the yoke on the side opposite said conducting element, said stop to stop the movement of said magnetic yoke a a predetermined distance in a second direction opposite to the first direction.

3. A circuit breaker as claimed in claim 2 wherein said stop is a part of said housing.

4. A circuit breaker as claimed in claim 2 wherein said circuit breaker also comprises a cover to said casing, said cover being molded of insulating material and said stop being molded integrally with said cover.

5. A circuit breaker as claimed in claim 2 wherein said activating means is connected to said yoke.

6. A circuit breaker as claimed in claim 5 wherein said latch comprises an armature mounted to said yoke, the movement of said armature being governed by said yoke and the position of said yoke.

7. A circuit breaker as claimed in claim 6 wherein said armature comprises a latch seat, and said release means comprises a trip lever having one end positioned in said latch seat when current is flowing through the circuit breaker.

8. An electric circuit breaker comprising:

a housing;

a stationary contact in said housing;

a movable contact carrier in said housing;

a movable contact mounted on said carrier and movable thereby into and out of engagement with said stationary contact;

a conducting element fixedly mounted within said housing, said conducting element providing a path for current;

a yoke connected to said conducting element, said yoke including a latch seat and a free end, said yoke being positioned proximate to and parallel to said conducting element, said yoke provided a path for current flow in a direction opposite the direction of current flow through said conducting element, said yoke moving in a first direction upon the occurrence of an overcurrent;

a releasably latchable trip lever connected to said contact carrier, said trip lever having a latched position and a tripped position, said trip lever having a free end seated within the latch seat of said yoke in a latched position, said trip lever being pivotably mounted in said housing and releasable from the latched position for movement to the tripped position upon said yoke moving in the first direction to separate said stationary contact and said movable contact; and a stop positioned a predetermined distance from the free end of said yoke on the side opposite said conducting element to stop the movement of said yoke at a predetermed distance in a second direction opposite to the first direction.

9. An electric circuit breaker comprising:

separable contacts;

tripping means for tripping said breaker to separate said contacts;

a bimetal providing a first current path, said bimetal moving in a first direction to activate said tripping means upon the occurrence of an overcurrent;

a conducting element positioned adjacent to and parallel to said bimetal, said conducting element providing a second current path opposite in direction to said first current path; and a stop to prohibit movement of said bimetal greater than a predetermined distance in a second direction opposite to the first direction.

10. An electric circuit breaker as claimed in claim 9, wherein said bimetal comprises a first end and a second end;

said tripping means includes a yoke fixedly attached to the first end of said bimetal, and said stop member prohibits movement of said yoke greater than a predetermined distance.

11. An electric circuit breaker as claimed in claim 10, wherein the second end of said bimetal is fixedly connected to said conducting element, said bimetal deflecting in a first direction, to activate said tripping means, and said stop member prohibiting yoke movement greater than a predetermined distance in a second direction.

12. An electric circuit breaker as claimed in claim 11, wherein said circuit breaker also comprises a housing and said stop member is connected to said housing.

13. An electric circuit breaker as claimed in claim 12, wherein said housing is molded of an insulating material and said stop is an integral part of said housing.

* * * * *